United States Patent [19]

Gray et al.

[11] Patent Number: 4,476,449

[45] Date of Patent: Oct. 9, 1984

[54] SWITCH ACTUATOR FOR A REMOTE CONTROL UNIT

[75] Inventors: Ronald N. Gray; Ronald G. Davis, both of Anderson, Ind.

[73] Assignee: General Motors Corporation, Detroit, Mich.

[21] Appl. No.: 481,791

[22] Filed: Apr. 4, 1983

[51] Int. Cl.[3] ..... H01H 9/00

[52] U.S. Cl. ..... 335/138; 335/125; 310/49 R; 310/156; 200/67 F; 200/1 R

[58] Field of Search ..... 335/138, 125, 122, 206, 335/207, 274; 200/67 F; 310/49, 156, 68 A

[56] References Cited

U.S. PATENT DOCUMENTS 3,127,602 3/1964 Russo et al. ..... 200/67 F 3,842,148 10/1974 Loubier ..... 264/24

3,872,334 3/1975 Loubier ..... 310/43

4,403,121 9/1983 Huntzinger et al. ..... 200/1 R

*Primary Examiner*—Joseph W. Hartary

*Assistant Examiner*—George Andrews

*Attorney, Agent, or Firm*—C. R. Meland

[57] ABSTRACT

An actuator for selectively actuating a circular array of electric switches. The actuator includes a molded plastic rotor part that contains particles of magnetic material. One portion of the rotor is magnetized to provide a permanent magnet that is effective to attract a switch actuating arm that is pivoted to the rotor. Another tubular portion of the rotor is magnetized to provide the rotor of an electric stepper motor. The stepper motor rotates the rotor to various positions. The arm can be attracted by an electromagnet and pivoted to a position in which it operates one of the circular array of switches.

4 Claims, 3 Drawing Figures

SWITCH ACTUATOR FOR A REMOTE CONTROL UNIT

This invention relates to an actuator for selectively operating a plurality of spaced control devices and more particularly to an actuator for selectively operating a plurality of electrical switches that are located in a circular array.

Actuators which form a part of a remote control unit and which are capable of selectively operating a circular array of switches are disclosed in U.S. patent application Ser. No. 289,787, filed on Aug. 3, 1981 and now U.S. Pat. No. 4,403,121. The switch actuators disclosed in that patent application comprises a rotor that can be rotatably adjusted by a stepper motor to selected rotative positions. A switch actuating lever is pivotally supported by the rotor and is biased in one direction by a spring. The lever can be moved in an opposite direction against the bias of the spring by the plunger of a solenoid or the lever can be formed of magnetic material and be attracted by an electromagnet to provide the opposite direction movement. The lever is selectively positioned to operate one of a plurality of electrical switches located in a circular array by rotation of the rotor to a selected rotative position.

One of the objects of this invention is to provide an improved actuator of the type disclosed in the above-referenced patent application that utilizes a minimum number of component parts and optimizes tolerance relationships as they relate to assembly and manufacturability. In carrying this object forward the rotor of the actuator is formed of a molded plastic material that contains particles formed of a magnetic material such as barium ferrite. One area of the rotor is magnetized to provide a permanent magnet that is effective to attract a switch actuating lever that is pivotally supported by the rotor. This permanent magnet eliminates the need for a lever biasing spring utilized in the actuator disclosed in the above-referenced patent application since it applies a magnetic force to the lever. The rotor further has an integral tubular portion that forms a permanent magnet rotor for an electrical stepper motor. The circumference of this tubular portion is magnetized to form alternate north and south poles and hence the tubular portion forms the rotor of a stepper motor.

The rotor of this invention is supported for rotation by a steel shaft that is connected to the rotor by insert molding the shaft to the rotor at the time the rotor is molded. This optimizes the concentric relationship of the shaft and rotor. The shaft is journalled in a metallic lubricant impregnated bearing that is supported by a member fixed to the stator assembly of the stepper motor.

IN THE DRAWINGS

Figure 1:
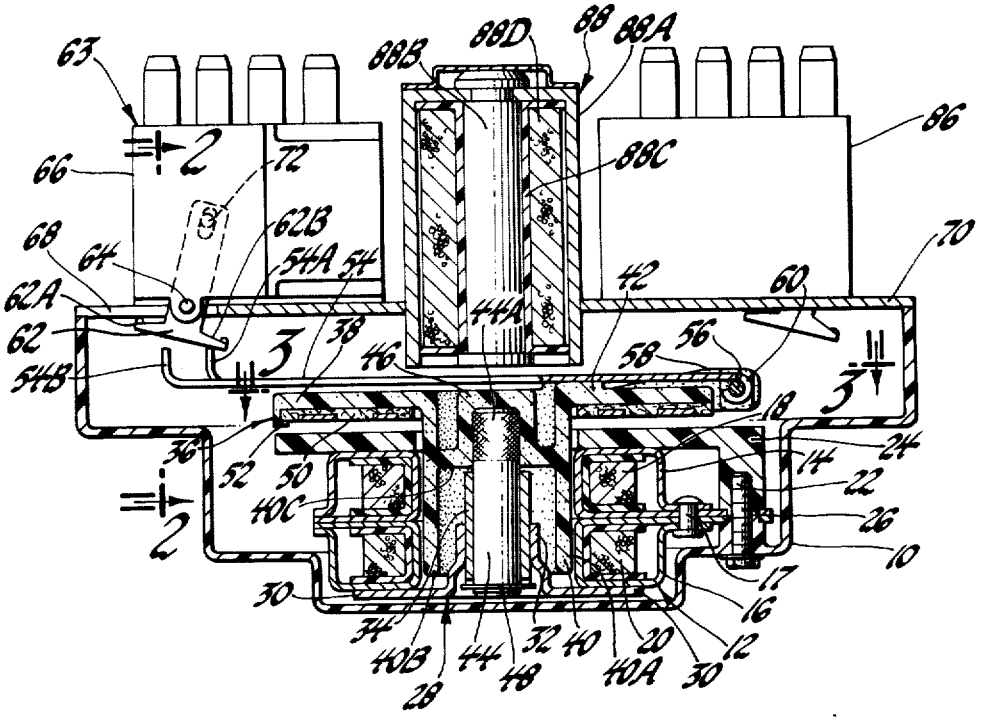
FIG. 1 is a sectional view of a switching unit that utilizes an actuator made in accordance with this invention.

Referring now to the drawings and more particularly to FIG. 1, the reference numeral 10 designates a housing which is formed of plastic material. The housing 10 supports an electric stepper motor stator assembly generally designated by reference numeral 12. The stator assembly 12 comprises housings 14 and 16 formed of metallic magnetic material which have laterally extending portions riveted together by a plurality of rivets, one of which is illustrated and designated by reference numeral 17. The housings 14 and 16 respectively contain field coils 18 and 20. The stator assembly 12 is supported by the housing 10 by means of a plurality of screws, one of which is illustrated and designated by reference numeral 22. The screws 22 are threaded into bosses formed in a cover member 24 which is formed of plastic material. The screws 22 pass through openings formed in laterally extending portions 26 of the metallic stator housings 14 and 16.

The housing 12 supports a metallic bearing support generally designated by reference numeral 28 which has laterally extending portions 30 which are welded to the metallic housing 16. The bearing support 28 further has a tubular portion 32 which supports a bearing 34. The bearing 34 is formed of a brass material that is impregnated with a lubricant and the bearing 34 has a press-fit with the tubular portion 32 of the bearing support 28.

The switching unit of FIG. 1 has a rotor which is generally designated by reference numeral 36. The rotor 36 is a molded part and is formed of a thermoplastic material such as nylon which contains a magnetic material such as barium ferrite. The barium ferrite is mixed with the thermoplastic material prior to molding so that the final molded part can be magnetized.

The rotor 36 has an annular portion 38 and has a tubular portion 40. The tubular portion 40 forms a permanent magnet rotor of an electric stepper motor. To this end the outer periphery 40A of the tubular portion 40 is magnetized with alternate north and south poles. The axial length of magnetization can be from the end 40B of tubular portion 40 to a point in line with the wall 40C. The axial length of magnetization corresponds substantially to the axial length of the stepper motor stator assembly 12. By way of example, tubular portion 40 may be magnetized to provide a 24 pole stepper motor rotor.

Figure 3:
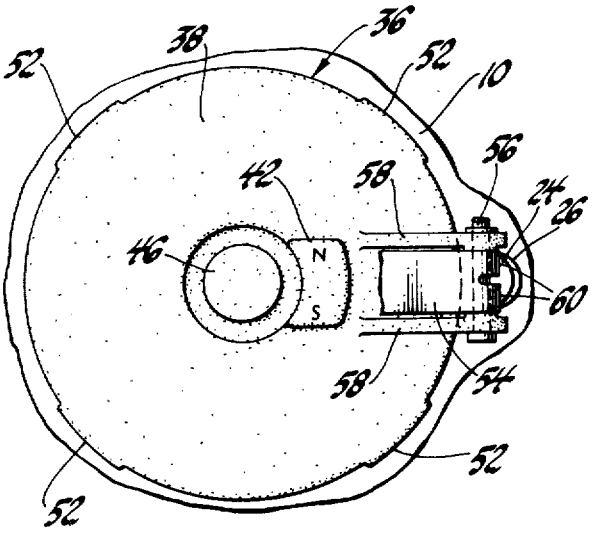
FIG. 3 is a view with parts broken away taken along line 3—3 of FIG. 1.

The rotor 36 is further magnetized over a raised pad portion designated by reference numeral 42. This pad portion is magnetized to provide a two pole permanent magnet having a north and south pole as illustrated in FIG. 3. The rotor 36 is fixed to a metal shaft designated by reference numeral 44. The shaft 44 has a knurled end 44A which is insert molded to portion 46 of the rotor 36 when the rotor 36 is molded. The shaft 44 rotates within the bearing 34 and is retained from axial movement by a snap ring 48 that fits within an annular slot formed in one end of the shaft 44.

The rotor 36 may carry an indicator card designated by reference numeral 50 which is secured to the underside of cylindrical portion 38 by ultrasonically spinning over portions 52 of the rotor. The card or code wheel 50 may comprise a disk of insulating material that carries a conductive pattern that cooperates with brushes (not illustrated) in a manner described in the above-referenced patent application.

The rotor 36 carries a switch actuating arm 54 which is formed of magnetic material such as steel. The actuator arm 54 is pivotally supported by rotor 36. This is accomplished by a hinge pin 56 which passes through openings formed in the ends of ribs 58. The ribs 58 are formed when rotor 36 is molded and the openings in the ribs 58 are formed by a drilling operation after part 36 is molded. The actuator arm 54 is pivotally secured to the pin 56 by hinge portions 60 which wrap around the pin as best illustrated in FIG. 1.

Figure 2:
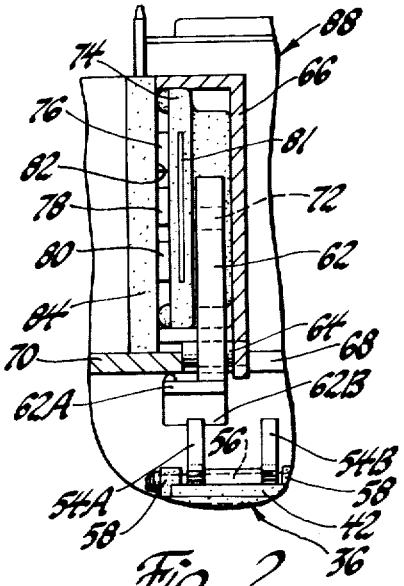
FIG. 2 is a view partly in section looking in the direction of the arrows of line 2—2 of FIG. 1.

The actuator arm 54 has a pair of integral switch actuating portions 54A and 54B. These actuating portions are radially spaced as shown in FIG. 1 and are also spaced transversely as illustrated in FIG. 2. The switch actuating portions 54A and 54B cooperate with generally T-shaped switch actuating lever 62 of an electric switch 63 and has end portions 62A and 62B. The lever 62 is pivotally supported by a pin 64 supported by switch housing 66. As can be seen in FIG. 1, the lower end of the lever 62 passes through an opening 68 formed in a switch supporting plate 70. The plate 70 is secured to the housing 10 in any conventional fashion. The rocker arm or lever 62 has an opening that receives a switch actuating pin designated by reference numeral 72. The pin 72, as best illustrated in FIG. 2, is connected to a contact carrier designated by reference numeral 74. The contact carrier 74 is formed of insulating material and carriers electrical contacts comprised of three metallic spring fingers 76, 78 and 80. These spring fingers extend from a flat portion 81 that fits within a slot formed in contact carrier 74. The contact carrier 74 can move laterally within the switch housing 66 and the flexible contacts 76, 78 and 80 cooperate with fixed contacts (not illustrated) embedded in the face 82 of fixed contact support 84 formed of insulating material.

It will be apparent from an inspection of FIGS. 1 and 2 that upward movement of arm 54, about pivot pin 56, will cause the switch actuator arm 62 to pivot about pin 64. Pivotable movement of arm 62 causes transverse movement of the contact carrier 74 to thereby move the contact carrier 74 from one switching position to another.

Assuming that actuator arm 62 is in the position shown in FIG. 1 and further assuming that the actuator portions 54A and 54B are in the position shown in FIG. 2, it will be apparent that upward movement of arm 54 will cause the lever 62 to pivot counterclockwise from the position shown to a position wherein an end 62B engages the lower wall of housing 70. During this upward movement of arm 54 portion 54A will engage lever 62 and portion 54B will clear the lever. This, of course, causes the contact carrier 74 to be shifted to a new position. Assuming now that the actuating lever 62 has been shifted counterclockwise, in the manner just described, it will be appreciated that if the rotor is now indexed or rotated to a position wherein arm portion 54B is aligned with portion 62A of the lever 62, an upward movement of arm 54 will now cause the lever to be pivoted clockwise back to its position shown in FIG. 1. During this movement of arm 54 portion 54A will be positioned to clear lever 62. It therefore can be seen that the switch arm 62 can be pivoted from one given position to another position depending upon the rotatable position of rotor 36.

In FIG. 1, only two switches 63 and 86 have been illustrated as being supported by the plate 70. It is to be understood that there are actually a plurality of switches located in a circular array that are supported by the plate 70 in a manner disclosed in the above-referenced patent application. Thus, selective rotation of the rotor 36, by the stepper motor, can selectively operate any one of the plurality of switches that are located in the circular array.

The actuator arm 54, as previously described, is formed of magnetic material such as steel and when it is desired to actuate a switch the arm 54 is attracted by energization of an electromagnet generally designated by reference numeral 88. The electromagnet 88 is supported by the plate 70 and has a tubular portion 88A formed of magnetic material, a core 88B likewise formed of magnetic material and a coil form 88C formed of insulating material which carries the coil 88D.

In summary, the two pole permanent magnet 42, which is an integral part of the rotor 36, maintains the arm 54 in the position shown in FIG. 1 since the permanent magnet attracts the arm to the position shown. When it is desired to operate one of the switches of the circular array of switches the stepper motor is energized to rotatably step the rotor 36 to the proper position. The electromagnet 88 is now energized which attracts the actuator arm 54 upwardly in FIG. 1 and about pivot pin 56 to thereby actuate switch actuating arm 62 from one given position to another. When the electromagnet 88 is deenergized the permanent magnet pad 42 attracts the arm 54 to a position where it engages the pad 42.

The embodiments or the invention in which an exclusive property or privilege is claimed are defined as follows:

1. An actuator for selectively operating a plurality of circumferentially spaced control devices located substantially in a circular array comprising, an electric stepper motor having a stator, a one-piece rotor member comprised of magnetic material having a portion located adjacent a bore of said stator that is magnetized to form a multipole permanent magnet rotor for the stepper motor, means for rotatably supporting said rotor, an actuator arm formed of magnetic material pivoted to said rotor member which can be positioned by said stepper motor to a position to operate a control device when the arm is pivoted away from said rotor member, said rotor member having a magnetized area that operates as a permanent magnet to attract said arm to said magnetized area, and an electromagnet for attracting said actuator arm away from said magnetized area and into engagement with a control device to operate the same.

2. An actuator for selectively operating a plurality of circumferentially spaced electric switches located substantially in a circular array comprising, an electric stepper motor having a stator, a one-piece rotor member comprised of a molded plastic material containing magnetic material, said rotor member having a cylindrical portion positioned within a bore of said stator that is magnetized with alternate north and south poles to form a multipole permanent magnet rotor for said stepper motor, means for rotatably supporting said rotor, a switch actuator arm formed of magnetic material provided to said rotor member which can be positioned by said stepper motor to a position to operate one of said switches when the arm is pivoted away from said rotor member, said rotor member having a magnetized area that operates as a permanent magnet to attract said arm to said magnetized area, and an electromagnet for attracting said actuator arm away from said magnetized area and into engagement with means for operating one of said switches.

3. An actuator for selectively operating a plurality of circumferentially spaced electric switches located substantially in a circular array comprising, an electric stepper motor having a stator, a one-piece rotor member comprised of a molded plastic material containing magnetic material, said rotor member having a cylindrical portion positioned within a bore of said stator that is magnetized with alternate north and south poles to form a multipole permanent magnet rotor for said stepper motor, means for supporting said rotor for rotation about an axis, a switch actuator arm formed of magnetic material pivoted to said rotor member at one end of the arm and extending across the axis of rotation of said rotor, said arm being selectively positioned by said stepper motor to operate one of said switches when the arm is pivoted away from said rotor member, said rotor member having a magnetized area that operates as a permanent magnet to attract said arm to said magnetized area, and an electromagnet for attracting said actuator arm away from said magnetized area and into engagement with means for operating one of said switches.

4. An actuator for selectively operating a plurality of circumferentially spaced electric switches located substantially in a circular array comprising, an electric stepper motor having a stator member, said stator member comprising metallic housing means containing field coil means and defining an internal bore, a bearing support secured to said housing means supporting a tubular axially extending bearing that is located at least partially in said stator bore, a one-piece rotor member comprised of a molded plastic material containing magnetic material, said rotor member having a tubular portion that is magnetized at its outer periphery with alternate north and south poles to form a multipole permanent magnet rotor for said stepper motor, a shaft insert molded to said rotor, said shaft located in said bearing and said tubular portion of said rotor disposed between said stator bore and said bearing, a switch actuator arm formed of magnetic material pivoted to said rotor member which can be positioned by said stepper motor to operate one of said switches when the arm is pivoted away from said rotor member, said rotor member having a magnetized area that operates as a permanent magnet to attract said arm to said magnetized area, and an electromagnet for attracting said actuator arm away from said magnetized area and into engagement with means for operating one of said switches.

* * * * *